US011440087B2

(12) United States Patent
Maurer

(10) Patent No.: US 11,440,087 B2
(45) Date of Patent: Sep. 13, 2022

(54) PLUNGER SYSTEM AND CASTING METHOD FOR A DIE CASTING MACHINE

(71) Applicant: Oskar Frech GmbH + Co. KG, Schorndorf (DE)

(72) Inventor: Peter Maurer, Bamberg (DE)

(73) Assignee: Oskar Frech GmbH + Co. KG, Schorndorf (DE)

( * ) Notice: Subject to any disclaimer, the term of this patent is extended or adjusted under 35 U.S.C. 154(b) by 26 days.

(21) Appl. No.: 17/225,782

(22) Filed: Apr. 8, 2021

(65) Prior Publication Data

US 2021/0316359 A1 Oct. 14, 2021

(30) Foreign Application Priority Data

Apr. 9, 2020 (DE) ..... 10 2020 204 634.4

(51) Int. Cl.
*B22D 17/20* (2006.01)
*B22D 17/32* (2006.01)

(52) U.S. Cl.
CPC ..... *B22D 17/203* (2013.01); *B22D 17/32* (2013.01)

(58) Field of Classification Search
CPC .. B22D 17/20; B22D 17/2015; B22D 17/203; B22D 17/2046; B22D 17/2053; B22D 17/2069; B22D 17/31; B29C 45/46; B29C 45/53
See application file for complete search history.

(56) References Cited

U.S. PATENT DOCUMENTS

| | | | |
|---|---|---|---|
| 4,311,185 | A | 1/1982 | Zimmerman |
| 4,743,190 | A | 5/1988 | Brunnschweiler et al. |
| 5,365,999 | A | 11/1994 | Stummer et al. |
| 6,581,670 | B1 | 6/2003 | Fink et al. |
| 2016/0279701 | A1* | 9/2016 | Tomioka ..... B22D 17/2015 |
| 2020/0078858 | A1 | 3/2020 | Dioni et al. |
| 2020/0147679 | A1 | 5/2020 | Ishibashi et al. |
| 2020/0282455 | A1 | 9/2020 | Sakazawa et al. |

FOREIGN PATENT DOCUMENTS

| | | |
|---|---|---|
| DE | 28 33 063 C2 | 1/1980 |
| DE | 34 33 121 C1 | 12/1985 |
| DE | 36 35 845 A1 | 4/1987 |

(Continued)

*Primary Examiner* — Kevin E Yoon
(74) *Attorney, Agent, or Firm* — Crowell & Moring LLP

(57) ABSTRACT

A casting plunger system for a die casting machine includes a stationary system part and a system part which moves relative to the stationary system part in a respective casting cycle for the introduction of melt material into a casting mould. The moved system part has a plunger, a plunger rod and a rod drive unit, and is configured to decelerate at the end of a mould filling phase of the casting cycle under the effect of pressure on the melt material. A casting method for a die casting machine is provided with such a plunger system. The moved system part has a mass which can be adjusted variably between different casting cycles, and/or the moved system part consists of a moved main system part and an additional mass unit which is arranged so as to be movable relative to the main system part and is configured to decelerate, at the end of the mould fill phase of the casting cycle, later by a predefined delay time than the main system part.

9 Claims, 2 Drawing Sheets

(56) References Cited

FOREIGN PATENT DOCUMENTS

| | | | | |
|---|---|---|---|---|
| DE | 86 03 526 | U1 | 6/1987 | |
| DE | 36 32 926 | A1 | 4/1988 | |
| DE | 42 18 556 | A1 | 12/1993 | |
| EP | 1 046 444 | A1 | 4/1999 | |
| JP | 8-300134 | A | 11/1996 | |
| JP | 2019-155378 | A | 9/2019 | |
| JP | 6630221 | B2 * | 1/2020 | ..... B22D 17/10 |
| WO | WO 00/72998 | A1 | 12/2000 | |
| WO | WO 2019/198218 | A1 | 10/2019 | |

* cited by examiner

PLUNGER SYSTEM AND CASTING METHOD FOR A DIE CASTING MACHINE

CROSS REFERENCE TO RELATED APPLICATION

This application claims priority under 35 U.S.C. § 119 from German Patent Application No. 102020204634.4, filed Apr. 9, 2020, the entire disclosure of which is herein expressly incorporated by reference.

BACKGROUND AND SUMMARY OF THE INVENTION

The invention concerns a casting plunger system for a die casting machine, wherein the plunger system comprises a stationary system part and a system part which moves relative to the stationary system part in a respective casting cycle for the introduction of melt material into a casting mould, and has a casting plunger, a casting plunger rod and a rod drive unit, and is configured to decelerate at the end of a mould filling phase of the casting cycle under the effect of pressure on the melt material; and a casting method for a die casting machine with such a plunger system.

Plunger systems of this type and associated casting methods are generally known for use in die casting machines, in particular for die casting of metallic parts. The respective casting cycle is usually composed of a prefill phase in which the melt material is transported or advanced up to a casting mould inlet, a mould filling phase in which the melt material is pressed into the casting mould, and a pressure-holding phase in which a holding pressure is exerted on the melt material in the casting mould via the plunger. The melt material is transported up to and into the casting mould by the corresponding melt-conveying movement of the moved system part relative to the stationary system part of the plunger system. The stationary system part in this case means e.g. the part of the plunger system held stationarily on an associated machine structure of the die casting machine, while the moved system part is the part of the plunger system which moves relative to the stationary system part for this melt transport, i.e. all components of the plunger system which are moved and decelerated at the end of the mould filling phase. During this deceleration process at the end of the mould filling phase, the forward movement of the moved system part is completely or at least largely braked, compressing the melt into the casting mould, wherein any residual forward movement or a degree of spring-back or oscillation movement is dissipated at the latest in the subsequent so-called pressure-holding phase, during which at the latest the moved system part comes to a complete standstill, if it has not already done so at the end of the mould filling phase.

The moved system part usually includes the plunger, the plunger rod at whose front end the plunger is coupled, and the rod drive unit which drives the plunger rod for transport of the melt material by the plunger and typically comprises a drive piston and a plunger coupling, via which the plunger rod, at its end opposite the plunger, is coupled to the drive piston. The drive piston is usually part of the so-called injection unit which designates the driving part of the plunger system. The plunger and the plunger rod are typically part of the so-called casting utensil, which designates the driven part of the plunger system. As a further part of the injection unit, optionally a so-called multiplier unit or pressure translation unit may be coupled to the drive piston, and serves to provide the holding pressure in the pressure-holding phase. The stationary system part of the plunger system in particular includes the components which serve to guide the movement of the components of the moved system part, e.g. a casting cylinder in which the drive piston is guided, and a casting chamber body which defines an e.g. cylindrical casting chamber in which the melt is initially present and in which the plunger moves.

At the end of the mould filling phase, the moved system part is braked in its forward movement relatively abruptly, completely or largely to a standstill, by the melt material filling the casting mould, wherein a so-called first pressure peak is formed for the melt material in the casting mould. This first pressure peak is important for the first compression of the melt material in the casting mould, in particular in regions of the casting mould or the resulting casting which are relatively far away from an insert region in which the melt material enters the casting mould. The pressure multiplication in the pressure-holding phase, because of its technically induced time delay and the incipient melt solidification, often cannot alone exert an adequate effect. Thus for example in die casting machines of the cold chamber type of smaller and medium size, the typical mould fill time, i.e. the duration of the mould filling phase, lies in the range from 10 ms to 15 ms, while in some cases the pressure multiplication effect, because of design, in the pressure-holding phase, is delayed by 15 ms to 35 ms relative to the end of the mould filling phase.

With respect to the first pressure peak in the casting mould, conventionally contradictory process goals are considered. On the one hand, the first pressure peak must be sufficiently high to achieve an adequate first compression of the melt material in the casting mould. On the other hand, too high a first pressure peak in the casting mould leads to so-called over-injection of the mould, which means that melt escapes over the mould edge in the mould parting plane, i.e. in the plane separating the movable mould half and the stationary mould half, which causes an undesirable burr formation and the necessity for subsequent further mechanical processing. Conventionally, observation of these process goals with respect to the first pressure peak is taken into account in that a dedicated speed profile is predefined for the development of the speed of the plunger and hence also of the other components of the moved system part of the plunger system across the casting cycle, in particular in the period of the mould filling phase. However, for the choice of an optimal plunger speed, in particular also during the mould filling phase, additional process parameters must be taken into account, such as with respect to the flow behaviour of the melt material in the casting chamber, optimisation of the duration of the mould filling phase, minimisation of the air turbulence and mould wear, as well as the casting mould geometry, flow resistance of the melt material and the performance of the injection unit as the drive-relevant part of the plunger system.

Patent publication DE 34 33 121 C1 defines a casting plunger system with a plunger coupling which integrates a hydraulic damping device for the rod drive unit, with a damping chamber and a damping piston displaceable therein, and a spring-loaded control piston which, because of inertia, may still move further at the end of the mould filling phase after deceleration of the plunger, and only in this damping case opens bores running between the damping chamber and storage chamber, and otherwise blocks these.

In laid-open publication JP 8-300134 A a plunger system is disclosed in which the plunger coupling has a pressure chamber containing an explosive medium which can be brought to explosion on transition from the prefill phase to the mould filling phase, in order to accelerate the advance of the plunger rod and plunger relative to the rod drive unit for performance of the mould filling phase.

Laid-open publication DE 42 18 556 A1 discloses a casting plunger system comprising a hydraulic two-cycle casting drive for a pressure piston on the one hand and a multiplier piston on the other hand and comprising a related valve control using fast controllable servo proportional valves to regulate the hydraulic medium amounts needed to act on the respective piston in a manner adjusted to each other.

Patent publication DE 28 33 063 C2 discloses a casting plunger system having a hollow formed casting piston and a casting piston damping arrangement between a piston rod and the casting piston so that the piston rod can move together with an inner piston to some extend into the hollow casting piston when being decelerated at the end of the mould filling phase at the same time as the casting piston.

The invention is based on the technical problem of providing a casting plunger system of the type cited initially which offers advantages in comparison with the above-mentioned prior art in the performance of casting processes with respect to achieving a high quality of the produced castings, and a casting method for a die casting machine equipped with such a plunger system.

The invention achieves this object by the provision of a plunger system and a casting method in accordance with the independent claims. Advantageous refinements of the invention are given in the dependent claims.

According to one aspect of the invention, the moved system part has a mass which can be adjusted variably between different casting cycles. Here, the variably adjustable mass should be understood to mean the so-called solid mass, i.e. the rigid mass, of the moved system part. This means that the mass of probably present moved gases and fluids, such as hydraulic fluids, is not considered to be part of this variably adjustable mass of the moved system part. The change of this mass thus necessitates a change of the solid mass, while eventual changes of fluid or gaseous masses are not considered for this. Mostly, the mass of the moved system part corresponds substantially to the sum of the masses of the casting piston, the casting piston rod, and the drive rod unit. According to a further aspect of the invention, which may be provided as an alternative or in addition to the above-mentioned aspect of the invention, the moved system part consists of a moved main system part and an additional mass unit which is arranged so as to be movable relative to the main system part and is configured to decelerate, i.e. come completely or largely to a standstill in its forward movement, at the end of the mould fill phase of the casting cycle, later by a predefinable delay time than the main system part. Here again, the additional mass unit should be understood to mean one or more solid masses, i.e. rigid masses or solid mass bodies, while any fluid or gaseous masses are not considered for this. For convenience, the solid masses are also shortly called masses in the following.

A common feature of both inventive aspects is that they allow a change of the momentum, inherent in the moved system part before the end of the mould filling phase, which acts on the melt material in the casting mould because of the deceleration of the moved system part at the end of the mould filling phase, independently of the plunger speed or speed of the moved system part. The momentum is defined in the known manner as the product of the mass and speed, and because the solid mass of the moved system part can be adjusted variably between different casting cycles, with the first above-mentioned inventive aspect it is thus possible to variably adjust the momentum of the moved system part, acting on the melt material in the casting mould, by the deceleration of the moved system part at the end of the mould filling phase of the respective casting cycle, accordingly for the various casting cycles without having to change for this the speed profile of the moved system part during the mould filling phase. According to the other inventive aspect, the effect of the momentum of the moved system part on the melt material in the casting mould at the end of the mould filling phase may be modified in its temporal development for a respective casting cycle, in that the additional mass unit is braked later than the main system part, and accordingly the momentum effect provided by the additional mass unit on the melt material in the casting mould takes effect with a corresponding delay relative to the momentum effect from the deceleration of the moved main system part.

It has been found that the effect of the momentum of the moved system part, resulting from the deceleration of the moved system part at the end of the mould filling phase of the respective casting cycle, on the melt material present in the casting mould in particular also determines, or in any case substantially influences, the first pressure peak for the melt material in the casting mould and hence the first compression of the casting resulting from the hardening of the melt material in the casting mould, and accordingly the properties or quality of the casting. The plunger speed need not be changed for this variable change and hence optimisation of the momentum effect of the moved system part on the melt material in the casting mould, and can accordingly be optimised in the conventional fashion with respect to other criteria, in particular with respect to the flow behaviour of the melt material on transport to and into the casting mould, and with respect to minimum air turbulence, minimum mould wear and short mould filling times.

The plunger system according to the invention thus allows optimisation of the casting process for the respective produced castings, in particular with respect to casting quality and/or economics, by the variable adjustment of the momentum effect of the moved system part on the melt material in the casting mould at the end of the mould filling phase, independently of the development of the plunger speed during the mould filling phase. In other words, with the casting method according to the invention, the casting process and hence in particular the quality of the produced castings can be optimised both by optimising the speed profile of the plunger during the casting cycle and also, independently thereof, by optimising the momentum effect of the moved system part of the plunger system on the melt material in the casting mould at the end of the mould filling phase.

The same applies to the casting method according to the invention, which is suitable for a die casting machine which is equipped with a casting plunger system according to the invention, wherein according to the method, at least one casting parameter of a respective casting cycle is detected, preferably one which substantially determines or co-determines and/or is indicative of the quality of the casting to be produced, and/or one which influences the effectiveness of the casting process, and the mass of the moved system part and/or the delay time for the relatively movably arranged additional mass unit can be adjusted variably for one or more future casting cycles, depending on the at least one detected casting parameter.

In advantageous implementations, the plunger system comprises a control unit which is configured to determine the optimal mass of the moved system parts to be set for the impending casting cycle or cycles, and/or the optimal delay time of the additional mass unit, which is arranged so as to be movable relative to the main system part, to be set for the impending casting cycle or cycles, preferably by evaluation of actual values, detected by sensors or otherwise during one or more preceding casting cycles, of one or more casting parameters, in particular casting parameters which the person skilled in the art knows influence or represent the quality of the produced casting and/or the effectiveness of the casting process. In this way, the control unit is able to automatically optimise the casting process or casting cycles, as applicable iteratively and/or by use of previously performed computer simulations.

In a refinement of the invention, the plunger system comprises one or more additional mass bodies which are each configured for releasable attachment to the moved system part and in the attached state form a component of the moved system part. Thus the mass and consequently the momentum of the moved system part, which acts on the melt material in the casting mould at the end of the mould filling phase, may be selected variably by selection of one or more of these predefined additional mass bodies and by the releasable attachment of the selected additional mass body or bodies to the moved system part for the respective casting cycle. The additional mass body may form said additional mass unit if arranged so as to be movable relative to the main system part. Alternatively, the additional mass body may be an additional mass which is arranged releasably and immovably on the otherwise moved system part.

In an embodiment of the invention, a plurality of additional mass bodies are provided, of which at least two additional mass bodies have a different mass. This offers good conditions for minimising the number of such additional mass bodies to be provided, in order to be able to set the mass of the moved system part variably within a certain predefinable value range. For example, the additional mass bodies for this may differ in their respective mass in binary steps, i.e. by powers of the number 2, or alternatively in a differently stepped distribution. Alternatively, the additional mass bodies may e.g. each have the same mass, and i.e. they may then for example be produced as identical parts. In corresponding embodiments, the plunger system comprises a control unit which is configured for automatic selection of a respective additional mass body to be attached to the moved system part. For this selection, the control unit preferably uses information on casting parameters relevant to the casting process for an impending casting cycle and/or from one or more preceding casting cycles.

In an embodiment of the invention, the stationary system part has an additional mass storage unit for stored provision of the additional mass body or bodies. In this way, the additional masses may very easily be provided for use on the moved system part. An additional mass selected for this use is extracted from the storage unit on the stationary system part and coupled to the moved system part. Alternatively, the additional mass body or bodies may be provided externally or separately from the plunger system, e.g. at another position of the machine structure of the die casting machine on which the plunger system is provided.

In one embodiment of the invention, the plunger system has an additional mass handling unit which is configured for automatic attachment and removal of a respective additional mass body to and from the moved system part. This handling unit may e.g. be implemented by a fully automatic handling robot or alternatively by a semiautomatic and partly user-actuated handling device.

In a refinement of the invention, the plunger system comprises a set of a plurality of casting plungers with predefined different mass, which are configured for interchangeable use as a plunger of the moved system part, in order in this way to be able to set the mass of the moved system part variably between different casting cycles, wherein the pistons differ in their mass by predefined mass increments. To achieve a respective optimal momentum of the plunger system at the end of the mould filling phase, in this case the respective most suitable plunger from the set of several plungers with predefined different mass may be selected and used as a plunger of the moved system part. The mass increments may be predefined in any desired fashion, e.g. all of the same size or at least partly of different sizes.

In order to be able to retain the casting chamber unchanged, it is preferred if the plungers in this embodiment variant of the invention have the same outer diameter. Since also the selection of materials suitable for the plungers is relatively restricted because of the requirements imposed thereon with respect to strength and direct melt contact, in this case the achievable mass variation of the plungers in general is limited accordingly, which makes this implementation of the invention preferably suitable for smaller mass changes.

In a refinement of the invention, the plunger system comprises a set of a plurality of casting plunger rods with predefined different mass, which are configured for interchangeable use as a plunger rod of the moved system part, wherein the plunger rods differ in their mass by predefined mass increments. In order to achieve an optimal momentum of the plunger system at the end of the mould filling phase, in this case the respective most suitable plunger rod is selected from the set of several plunger rods with predefined different mass and used as a plunger rod of the moved system part. The mass increments may be predefined in any desired fashion, e.g. all of the same size or at least partly of different sizes.

In advantageous implementations, the casting plunger rods with predefined different mass are configured for use with the same casting plunger, or in any case with casting plungers of the same outer diameter, and preferably also for use with the same casting chamber, so that by exchange of the casting plunger rod, the mass of the moved system part can be changed in the desired fashion without a different casting chamber or casting plunger with a different outer diameter being required. For plunger rods with different weight, in this case preferably an outer diameter is selected which is the same over the insertion depth in the casting chamber. The different mass may e.g. be provided by the use of materials of different weight and/or by a different design of the plunger rods in their axial region outside their immersion depth in the casting chamber, in particular with respect to their outer diameter. The insertion depth here means the axial region of the plunger rods with which they can be maximally immersed in the casting chamber, i.e. when the plunger is maximally advanced at the end of the pressure-holding phase. Since the plunger rod constitutes a component of the plunger system which is usually relatively easy to exchange, but also contributes to a significant proportion to the total mass of the moved system part, this implementation of the invention may be of particular advantage for numerous applications.

In a refinement of the invention, the plunger system comprises a set of a plurality of casting plunger couplings with predefined different mass, which are configured for interchangeable use as a casting plunger coupling of the rod drive unit of the moved system part, wherein the plunger couplings differ in their mass by predefined mass increments. To achieve a respective optimal momentum of the plunger system at the end of the mould filling phase, in this case the respective most suitable plunger coupling from the set of the plurality of plunger couplings with predefined different mass may be selected and used as a plunger coupling of the moved system part. The mass increments may be predefined in any desired fashion, e.g. all of the same size or at least partly of different sizes. The use of plunger couplings of different weights requires no changes to the casting chamber.

In a refinement of the invention, the plunger system comprises a set of a plurality of casting plunger drive pistons with predefined different mass, which are configured for interchangeable use as a casting plunger drive piston of the rod drive unit of the moved system part, wherein the plunger drive pistons differ in their mass by predefined mass increments. To achieve a respective optimal momentum of the plunger system at the end of the mould filling phase, in this case the respective most suitable plunger drive piston from the set of several plunger drive pistons with predefined different mass may be selected and used as a plunger drive piston of the moved system part. The mass increments may be predefined in any desired fashion, e.g. all of the same size or at least partly of different sizes. The use of plunger drive pistons of different weights requires no changes to the casting chamber.

In a refinement of the invention, the additional mass unit of the moved system part, which is arranged so as to be movable relative to the main system part, contains an additional mass body which is slidingly movable on the moved main system part between a starting position and an end position, wherein the starting position is defined by an initial end stop on the moved main system part and/or the end position is defined by an impact end stop on the moved main system part. The additional mass unit in this case, after deceleration of the moved main system part at the end of the mould filling phase, because of its mass inertia at first moves out of the starting position with substantially unchanged speed and then, on reaching the impact end stop, decelerates in order to deploy its momentum effect with a corresponding delay on the main system part and via this on the melt material in the casting mould.

It is understood that the relatively movable additional mass unit may comprise, depending on requirement and application, several individual such additional mass bodies each with associated, preferably variable, slide stroke. In corresponding system embodiments, the slide strokes of the slidingly movable additional mass bodies may differ, whereby they exert their momentum effect on the melt material in the casting mould at different times at the end of the mould filling phase, which allows a great variability in the temporal development of the momentum effect of the moved system part on the melt material in the casting mould.

In an embodiment of the invention, the initial end stop is adjustable on the moved main system part. Alternatively or additionally, the impact end stop is adjustable on the moved main system part. Each of these two measures allows an adjustment of the slide stroke of the additional mass unit on the moved main system part, and hence of the delay time by which the additional mass unit is decelerated later than the main system part at the end of the mould filling phase.

In an advantageous embodiment variant, it may furthermore be provided that the slide stroke of the additional mass unit may be adjusted variably, manually or automatically, depending on the casting speed with which the moved system part moves before deceleration during the mould filling phase. Thus for example, if required, the delay time of the additional mass unit may then be kept substantially constant if the casting speed is changed for adaptation to other circumstances, e.g. use of a different casting mould and/or a different casting melt material.

In an embodiment of the invention, the plunger system comprises a locking unit for releasable locking of the additional mass body in the starting position or in the end position or in a predefinable locking position between the starting position and the end position. On activation of the locking unit, this locks the additional mass body in the respective position and thereby makes it into an additional mass body which is coupled immovably to the moved main system part and which then deploys its momentum effect on the melt material in the casting mould at the end of the mould filling phase at the same time as the other moved system part. After release of this locking, the additional mass body may again function as an additional mass unit acting on the melt material in the casting mould with a delay relative to the other moved system part.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
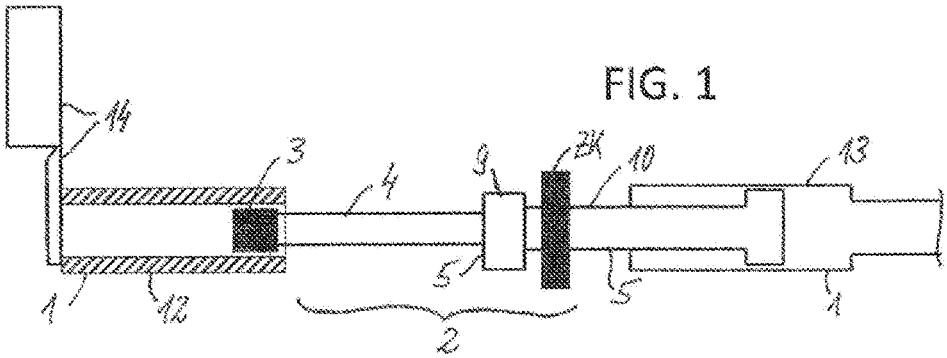
FIG. 1 shows a schematic side view of a plunger system and associated casting chamber and casting mould of a plunger system according to the invention with an additional mass body fixed to the plunger drive piston, for a die casting machine.

FIG. 1 shows schematically a casting plunger system for a die casting machine, wherein the plunger system contains a stationary system part 1 and a moved system part 2. The stationary system part 1 comprises for example, as shown, a casting chamber 12 and a casting plunger drive cylinder 13, the latter often known in brief as a casting cylinder. The casting chamber 12 opens as usual in a casting mould 14 which is formed by a fixed casting mould half and a movable casting mould half of the die casting machine. The moved system part 2 is movable relative to the stationary system part 1 in order to introduce melt material into the casting mould 14 in a respective casting cycle, for which it comprises a casting plunger 3, a casting plunger rod 4 and a rod drive unit 5, and is configured to decelerate at the end of a mould filling phase of the casting cycle under the effect of pressure on the melt material.

The plunger 3 is arranged fluid-tightly and axially movably in the e.g. cylindrical casting chamber 12. In the example shown, the plunger rod 4 carries the plunger 3 on its front end face region, and at its rear end face region is coupled to the rod drive unit 5, in particular to a plunger coupling 9 of the rod drive unit 5. In the example shown, the plunger coupling 9 couples the plunger rod 4 to a front end face region of a plunger drive piston 10 of the rod drive unit 5 which is guided so as to be axially movable in the plunger drive cylinder 13. Optionally, the plunger drive piston 10 is coupled to a pressure multiplier unit (not shown).

The moved system part 2 has a solid mass which can be variably adjusted between different casting cycles, and/or—as in the exemplary embodiment of FIG. 5—consists of a moved main system part 2*a* and an additional solid mass unit $Z_E$ which is arranged so as to be movable relative thereto and configured to decelerate, at the end of the mould filling phase of the casting cycle, later by a predefinable delay time than the main system part 2*a*.

Figure 2:
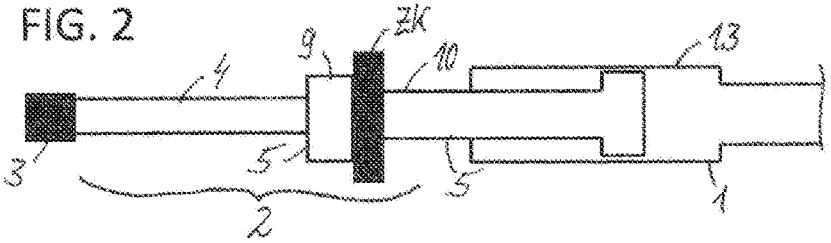
FIG. 2 shows the view from FIG. 1 without casting chamber and casting mould, in an embodiment variant of the plunger system according to the invention with an additional mass body fixed to the plunger coupling.
Figure 3:
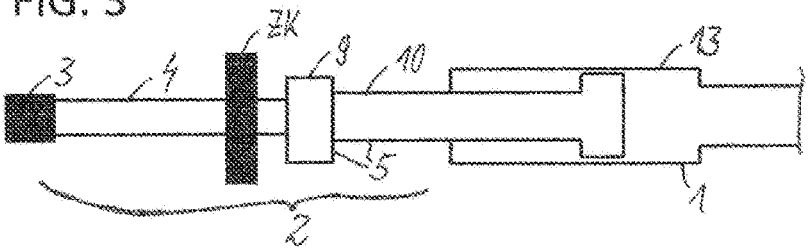
FIG. 3 shows the view from FIG. 2 for an embodiment variant of the plunger system according to the invention with an additional mass body fixed to the plunger rod.
Figure 4:
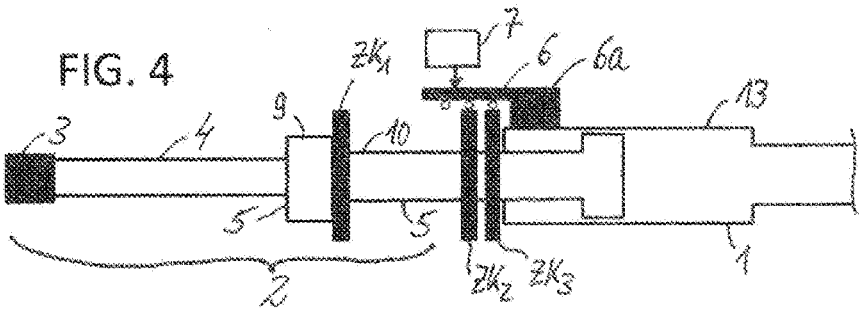
FIG. 4 shows the view from FIG. 2 for an embodiment variant of the plunger system according to the invention with optional additional mass bodies which may be coupled additionally.

In corresponding embodiments, the plunger system comprises one or more additional solid mass bodies which are respectively configured for releasable attachment to the moved system part 2, and in the attached state form an immovably coupled component of the moved system part 2. FIG. 1 shows an embodiment variant in this respect in which such an additional mass body ZK is releasably attached in particular to the plunger drive piston 10 of the moved system part 2. FIG. 2 shows an embodiment variant in this respect in which such an additional mass body ZK is releasably attached in particular to the plunger coupling 9 of the moved system part 2. FIG. 3 shows an embodiment variant in this respect in which such an additional mass body ZK is releasably attached in particular to the plunger rod 4 of the moved system part 2. It is understood that in this case, the additional mass body ZK is arranged at an axial portion of the plunger rod 4 which lies outside or behind an immersion depth, by which a front rod portion of the plunger rod 4 is immersed to a maximum in the casting chamber 1 in order to advance the plunger 3, so that the additional mass body ZK does not hinder the advance movement of the front immersion depth portion of the plunger rod 4 into the casting chamber 12. FIG. 4 shows an embodiment variant in this respect in which several such additional mass bodies $ZK_1$, $ZK_2$, $ZK_3$ may be optionally releasably attached to the moved system part 2, e.g. to the plunger coupling 9 or the plunger drive piston 10, wherein FIG. 4 shows a situation in which only a first additional mass body $ZK_1$ is releasably attached to the moved system part 2, here in particular to the plunger coupling 9. Preferably, it is provided that the assembly and disassembly of the one or more additional mass bodies ZK or $ZK_1$, $ZK_2$, . . . may be accomplished without tools and/or using a fast change system or a fast clamping system.

In such embodiment variants with several additional mass bodies $ZK_1$, $ZK_2$, which may be releasably attached to the moved system part 2, it may be advantageous if at least two of the several additional mass bodies $ZK_1$, $ZK_2$, . . . have different masses. For example, these additional mass bodies $ZK_1$, $ZK_2$, . . . may differ in mass by powers of the number 2, i.e. the next heavier additional mass body has twice the mass of the next lighter additional mass body. With such a binary stepping of the masses of the additional mass bodies $ZK_1$, $ZK_2$, . . . , an arbitrary integral multiple of the smallest mass of the lightest additional mass body may be set, with a comparatively low number of additional mass bodies to be provided for the total mass of all additional mass bodies $ZK_1$, $ZK_2$, . . . .

In corresponding embodiments, as in the exemplary embodiment of FIG. 4, the stationary system part 2 comprises an additional mass storage unit 6 for stored provision of the additional mass body or bodies ZK or $ZK_1$, $ZK_2$, . . . . For example, FIG. 4 shows an embodiment in which the additional mass bodies $ZK_1$, $ZK_2$, . . . are removably suspended on an additional mass holder 6*a* functioning as an additional mass storage unit 6, which in turn is arranged on the stationary system part 1, e.g. the plunger drive cylinder 13, or alternatively on another stationary fixed component of the respective die casting machine. The additional mass bodies $ZK_1$, $ZK_2$, . . . stored in this way may then as required be extracted individually or in arbitrary combinations from the additional mass storage unit 6 and releasably attached to the moved system part 2 in order to perform the respective casting cycle with the desired total mass of the moved system part 2.

In corresponding implementations, the plunger system comprises an additional mass handling unit 7 which is configured for automatic attachment of the respective additional mass body ZK or $ZK_1$, $ZK_2$, . . . on the moved system part 2, and for automatic removal of the respective additional mass body ZK or $ZK_1$, $ZK_2$, . . . from the moved system part 2. Such an additional mass handling unit 7 is shown as a block diagram in FIG. 4, in the exemplary embodiment shown there. It may for example comprise a conventional handling robot which is specifically configured to perform the necessary handling measures. Alternatively, the additional mass body ZK or $ZK_1$, $ZK_2$, . . . may be attached to and removed from the moved system part 2 by corresponding operating personnel.

Figure 6:
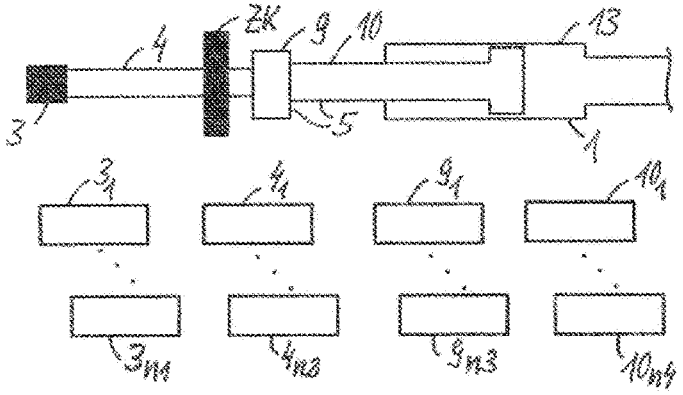
FIG. 6 shows the view in FIG. 2 for an embodiment variant of the plunger system according to the invention with a set of several plungers and/or plunger rods and/or plunger couplings and/or plunger drive pistons, each of predefined different mass.

In corresponding embodiments, the plunger system—as illustrated in FIG. 6—comprises a set of a plurality of casting plungers $\mathbf{3}_1$ to $\mathbf{3}_{n1}$, shown as a block diagram in FIG. 6, with predefined different mass, which differ in their mass by predefined mass increments and are configured for interchangeable use as a plunger 3 of the moved system part 2; and/or a set of a plurality of casting plunger rods $\mathbf{4}_1$ to $\mathbf{4}_{n2}$, shown as a block diagram in FIG. 6, with predefined different mass, which differ in their mass by predefined mass increments and are configured for interchangeable use as a plunger rod 4 of the moved system part 2; and/or a set of a plurality of casting plunger couplings $\mathbf{9}_1$ to $\mathbf{9}_{n3}$, shown as a block diagram in FIG. 6, with predefined different mass, which differ in their mass by predefined mass increments and are configured for interchangeable use as a plunger coupling 9 of the rod drive unit 5 of the moved system part 2; and/or a set of a plurality of casting plunger drive pistons $\mathbf{10}_1$ to $\mathbf{10}_{n4}$, shown as a block diagram in FIG. 6, with predefined different mass, which differ in their mass by predefined mass increments and are configured for interchangeable use as a plunger drive piston 10 of the rod drive unit 5 of the moved system part 2.

Depending on application and the desired total mass of the moved system part 2, the plunger 3 actually used may be selected from the number n1 of present plungers $\mathbf{3}_1$ to $\mathbf{3}_{n1}$ of different mass; and/or the plunger rod 4 actually used may be selected from the number n2 of plunger rods $\mathbf{4}_1$ to $\mathbf{4}_{n2}$ of different mass; and/or the plunger coupling 9 actually used may be selected from the number n3 of plunger couplings $\mathbf{9}_1$ to $\mathbf{9}_{n3}$ of different mass; and/or the plunger drive piston 10 actually used may be selected from the number n4 of plunger drive pistons $\mathbf{10}_1$ to $\mathbf{10}_{n4}$ of different mass. Depending on system design, of the four said sets of plungers $\mathbf{3}_1$ to $\mathbf{3}_{n1}$, plunger rods $\mathbf{4}_1$ to $\mathbf{4}_{n2}$, plunger couplings $\mathbf{9}_1$ to $\mathbf{9}_{n3}$, and plunger drive pistons $\mathbf{10}_1$ to $\mathbf{10}_{n4}$, all four sets may be present for a given plunger system, or only one of the four sets, or any two or three of the four sets may be provided.

In this type of embodiment of the invention, the mass of the moved system part 2 may be adjusted variably between different casting cycles by selection of a different plunger and/or a different plunger rod and/or a different plunger coupling and/or a different plunger drive piston. If necessary, in addition the releasable attachment of one or more additional mass bodies to the moved system part 2 may be provided, as illustrated in the example shown in FIG. 6 by the additional mass body ZK releasably attached to the plunger rod 4. Also, this type of embodiment may if necessary be supplemented by the above-mentioned additional mass unit $Z_E$ which is arranged so as to be movable relative to the moved main system part 2*a*.

The mass increments by which the respective plungers $\mathbf{3}_1$ to $\mathbf{3}_{n1}$, plunger rods $\mathbf{4}_1$ to $\mathbf{4}_{n2}$, plunger couplings $\mathbf{9}_1$ to $\mathbf{9}_{n3}$, and plunger drive pistons $\mathbf{10}_1$ to $\mathbf{10}_{n4}$ differ in their mass may be predefined suitably depending on circumstances or requirements. Here it is usually convenient to keep the mass increments between each two components with successive mass, and/or the total mass difference between the lightest and the heaviest component of the respective set, within predefined limits. This may be achieved for example by predefining a suitable threshold value by which the mass increments of the respective component set may differ at most, and/or by which the mass of the heaviest component of the respective set may be greater at most than the mass of the lightest component of the set, e.g. given as a percentage.

In corresponding embodiments, the additional mass unit $Z_E$ arranged so as to be movable relative to the main system part 2*a* comprises an additional mass body $Z_M$ which is arranged on the moved main system part 2 so as to be slidingly movable between a starting position and an end position, wherein the starting position is defined by an initial end stop IA on the moved main system part 2*a* and/or the end position is defined by an impact end stop AA on the moved main system part 2*a*. FIG. 5 shows a corresponding exemplary embodiment which has both the initial end stop IA and the impact end stop AA on the moved main system part 2.

In advantageous implementations, at least the initial end stop IA or the impact end stop AA is adjustable on the moved main system part 2, wherein also an adjustability of both end stops IA, AA may be provided. The end stop may as required be adjusted manually, e.g. by a manually actuated screw spindle, or automatically by a corresponding actuator mechanism. In the exemplary embodiment of FIG. 5, the impact end stop AA is provided on the plunger coupling 9, while the initial end stop IA is provided by an initial end stop body 8 which is established so as to be axially adjustable on the plunger drive piston 10.

The additional mass body $Z_M$ may accordingly move slidingly relative to the remainder of the moved system part, i.e. relative to the moved main system part 2*a*, by a slide stroke or stroke H corresponding to the axial spacing of the starting position and end position. If the moved main system part 2*a* together with the additional mass body $Z_M$ moves with a predefined advance speed during the mould filling phase, and the moved main system part 2*a* decelerates at the end of the mould filling phase, the slidingly movable additional mass body $Z_M$ retains this advance speed initially until it has covered its stroke H from the starting position to the end position, and then decelerates at the impact end stop AA. The additional mass body $Z_M$ thus decelerates, at the end of the mould filling phase of the casting cycle, later by a predefined delay time than the main system part 2*a*, which time results from the quotient of the stroke H divided by the advance speed of the moved system part 2 at the end of the mould filling phase immediately before deceleration of the moved main system part 2*a*.

In the case of adjustability of at least one of the two end stops IA, AA, which means a corresponding adjustment of the stroke H, according to the above-mentioned functional connection with the stroke H, the delay time by which the additional mass body $Z_M$ decelerates later than the main system part 2*a* can be predefined variably in the desired fashion, without it being necessary to change the advance speed for the moved system part 2.

Figure 5:
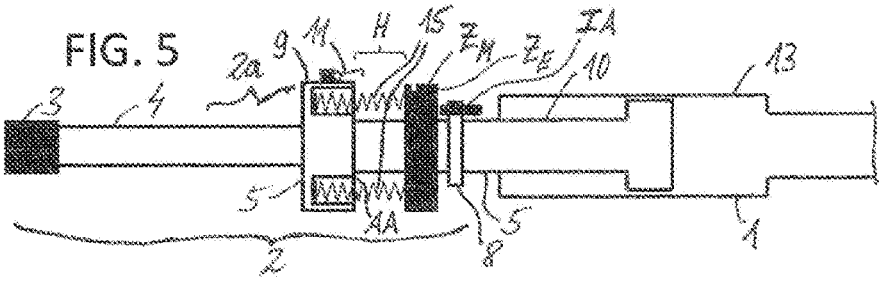
FIG. 5 shows the view from FIG. 2 for an embodiment variant of the plunger system according to the invention with a slidingly movably arranged additional mass body.

In the exemplary embodiment of FIG. 5, the relatively movable additional mass unit $Z_E$ consists solely of the additional mass body $Z_M$, while in alternative embodiments the relatively movable additional mass unit $Z_E$ comprises one or more further additional mass bodies which are arranged so as to be movable in a desired fashion relative to the moved main system part 2*a*. In further alternative embodiments, as well as the additional mass unit $Z_E$, one or more additional mass bodies in the manner of the additional mass body ZK of FIGS. 1 to 3, or in the manner of the additional mass bodies $ZK_1$, $ZK_2$, . . . of FIG. 4 are provided, which are configured for releasable attachment to the moved system part 2 and in the attached state form a component of the moved system part 2 which is immovably coupled to the remainder of the moved system part.

While the immovably coupled attachment of additional mass bodies, such as the one additional mass body ZK in FIGS. 1 to 3 or the several additional mass bodies $ZK_1$, $ZK_2$, . . . in the exemplary embodiment of FIG. 4, leads to a corresponding additional momentum transfer to the melt material at the end of the mould filling phase precisely at the time of the primary momentum transmission from deceleration of the moved system part 2 or moved main system part 2*a*, the relatively movable coupling of the additional mass unit $Z_E$ to the remainder of the moved system part, i.e. the main system part 2*a*, leads to an additional momentum transmission to the melt material which, at the end of the mould filling phase, takes place later by the predefinable delay time than the primary momentum transmission from the deceleration of the moved main system part 2*a*.

To clarify this using an example with figures, let assume for example that the advance speed of the moved system part 2 towards the end of the mould filling phase is 5 m/s, and the fixed mass of the moved main system part 2*a* is 100 kg, the mass of the additional mass unit $Z_E$ is 20 kg, and the slide stroke H of the additional mass unit $Z_E$ is 50 mm. Then the additional mass unit $Z_E$ applies to the melt material an additional momentum of 20% relative to the momentum of the fixed mass of the moved main system part 2*a*, wherein this momentum transmission begins 10 ms after the momentum transmission from the deceleration of the moved main system part 2*a*. The delayed momentum transmission effect may, favourably for the process, bridge the time period between the first pressure peak, which trails 2 *s* behind the momentum transmission of the fixed mass of the moved main system part at the time of the end of mould filling, and an action of an optional pressure multiplier device which typically begins only approximately 20 ms to 35 ms after the end of mould filling, without here the first pressure peak being excessively raised, so that any over-injection of the mould can be avoided.

The delayed timing of the additional momentum transmission to the melt material imposed by the additional mass unit $Z_E$ may be influenced in targeted fashion depending on the circumstances or casting parameters, in particular depending on the plunger speed and the structural casting arrangement. By adjusting the end stop, i.e. adjusting the slide stroke H, if required the delayed momentum transmission effect may be adjusted variably in order to optimise the process for the successive casting cycles. Here if desired, also the mass of the additional mass unit $Z_E$ may be varied e.g. by exchanging the additional mass unit $Z_E$ or by constructing the additional mass unit $Z_E$ out of a variable number of additional mass bodies which can be optionally coupled relatively movably to the moved main system part 2*a*. In this way, the strength and/or timing of this additional momentum transmission to the melt material at the end of the mould filling phase can be adjusted so as to achieve the desired optimal casting quality, which may be determined for example empirically or by computer simulation.

In corresponding implementations of the invention, the moved system part 2 comprises several additional mass units $Z_E$ which are arranged so as to be movable relative to the main system part 2*a* and, at the end of the mould filling phase of the casting cycle, decelerate later by a respective individually predefinable delay time than the main system part 2*a*. For each additional mass unit $Z_E$, in this case their mass and hence the strength of the additional momentum transmission applied to the melt material, may be established individually, as may the time at which they transmit the additional momentum to the melt material by their deceleration. If required, with this embodiment variant, a temporally staggered, successive additional momentum transmission to the melt material may be provided by the several successively decelerated additional mass units $Z_E$.

In advantageous implementations, the plunger system—as shown for the exemplary embodiment of FIG. 5—comprises a locking unit 11 for releasable locking of the additional mass body $Z_M$ in the starting position or in the end position or in a predefinable locking position between the starting position and the end position. For example, in the implementation of FIG. 5, the locking unit 11 is formed by a locking bar device with a locking bar which is held pivotably on the plunger coupling 9 and engages in a corresponding bar receiver on the additional mass body $Z_M$ when the additional mass body $Z_M$ has reached its end position, i.e. in this case, the impact end stop AA on the plunger coupling 9.

The locking unit 11 ensures that the additional mass body $Z_M$ is held firmly in position after reaching its impact end stop AA. After completion of the casting process, the lock is released so that the additional mass body $Z_M$ can return to its starting position. The return movement of the additional mass body $Z_M$ may optionally, as in the example of FIG. 5, be supported by a return spring arrangement 15 which, in this example, is held on one side on the additional mass body $Z_M$ and on the other side in a receiver in the plunger coupling 9.

Figure 7:
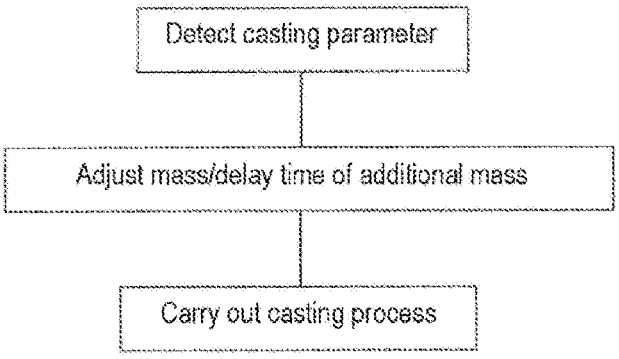
FIG. 7 shows a schematic flow diagram to illustrate steps of interest in the present case of a casting method according to the invention.

FIG. 7 illustrates in a schematic flow diagram a casting method, with only the method steps of interest here, for a die casting machine equipped with a plunger system according to the invention, i.e. in an embodiment of the type shown in one of FIGS. 1 to 6. As known in itself, for the performance of a respective casting cycle, one or more casting parameters are detected which are derived from one or more preceding casting cycles and/or predefined for the impending casting cycle. These casting parameters are detected by a machine control system which is typically fitted to the die casting machine and also forms or comprises a control unit for the plunger system. The control unit for the plunger system, also known in itself, is configured to control or adjust the respective casting process.

Characteristically, in the plunger system, the control unit determines the mass of the moved system part 2 to be set optimally for the impending casting cycle or cycles, and/or the delay time to be set optimally for the impending casting cycle or cycles for the additional mass unit $Z_E$ which is arranged so as to be movable relative to the main system part 2*a*. Preferably, for this the control unit evaluates actual values, detected by sensors or otherwise and belonging to one or more preceding casting cycles, for one or more casting parameters, in particular casting parameters which influence or represent the quality of the produced casting and/or the effectiveness of the casting process. The control unit is thereby able to optimise the casting cycle automatically depending on the design of the control system, either purely by control and/or iteratively and/or using computer simulations previously performed and/or by means of real-time control interventions during the respective casting process.

According to the method therefore, as indicated in FIG. 7, the mass of the moved system part 2 and/or the delay time for the relatively movably arranged additional mass unit $Z_E$, for one or more future casting cycles, is adjusted variably depending on the at least one detected casting parameter. Then the casting process is carried out with correspondingly optimised casting process management.

In corresponding embodiments, as part of the performance of the casting processes according to the method and by means of an algorithm suitably stored therein, the control unit is configured to establish—from the plunger position, the plunger speed i.e. the advance speed of the moved system part 2, and the mass of the moved system part 2 or the mass of the moved main system part 2*a* and the mass of the slidingly movable additional mass unit $Z_E$—the associated momentum or a momentum equivalent relevant for the momentum transmission to the melt material, and to provide this for further processing. This may for example also be used to indicate or depict, visually or otherwise, the determined momentum transmission effect as a measure of the compression effect of the first pressure peak taking place in the melt at the end of the mould filling phase.

Furthermore, in corresponding embodiments, the control unit is configured to determine—for a desired height of the first pressure peak depending on the influence factors present for the given die casting machine or given plunger system—the necessary mass for the moved system part 2 or the moved system main part 2*a* and the relatively movable additional mass unit $Z_E$, or establish this empirically or by computer simulation using a specific map belonging to the casting to be produced. In addition or alternatively, the control unit may be configured to determine the optimal additional mass without knowledge of the actual pressure peak, in this case e.g. empirically from the evaluated casting quality, wherein the plunger speed is varied without changing the momentum effect.

The influence factors in particular are one or more of the following factors: the preselected or actual plunger speed in the mould filling phase; the mass of the moved system part 2 without the relatively movable additional mass unit $Z_E$ and without additional mass bodies ZK, $ZK_1$, . . . to be releasably attached; the closing force of the mould closing unit of the die casting machine; the impacted area of the casting and/or sprue; the weight of the casting and/or sprue; the casting characteristics, in particular with respect to wall thicknesses; the composition of the melt material; the plunger diameter active in the casting chamber 12; the dimensions of the plunger drive, in particular with respect to diameter and hydraulically effective areas; the hydraulic drive pressure of the plunger drive; the parameters of the optional pressure multiplier device, in particular with respect to dimensions and hydraulically effective areas of the multiplier unit, predefined pressure profile and multiplier system pressure; and the actual and/or maximally possible value for the slide stroke H in the case of a present, relatively movable additional mass unit $Z_E$.

Also, the control unit may be configured to determine—for a desired height of the first pressure peak with known mass of the present, relatively movable additional mass unit $Z_E$—the associated value for the slide stroke H depending on said influence factors, or to establish this from a map produced empirically or specifically by computer simulation for the casting to be produced. In this case too, the process may be similar if the actual pressure peak is not known, but the momentum transmission effect has been empirically assessed as good and only the plunger speed is to be varied, without changing the momentum transmission effect. An additional influence factor here, if the locking unit 11 is present, may be its locking state, i.e. whether or not the relatively movable additional mass unit $Z_E$ or the relatively movable additional mass body $Z_M$ is locked by the locking unit 11.

It is understood that selected mass changes for the moved system part 2 may be suitably taken into account by the control unit for the total control of the plunger system. Thus a change in mass of the moved system part 2 requires correspondingly changed drive forces to accelerate the moved system part 2.

The detection of the casting parameters is supported by suitable sensors, as will be readily understood by the person skilled in the art when knowing the sensor tasks. The sensors here may in particular include one or more of the following sensors: one or more limit switches for detecting the presence of immovably coupled additional mass bodies ZK, $ZK_1$, . . . and/or the relatively movable additional mass unit $Z_E$; hard-wired and/or wireless identification sensors for identifying individual additional mass bodies and/or assembly components of the plunger system, and in particular its moved system part 2; acceleration sensors, the sensor information from which may be analysed together with sensor data from the casting drive system, in particular with respect to position, pressures etc., in order to determine the total mass of the moved system part 2; a sensor for measuring the actual slide stroke H when the relatively movable additional mass unit $Z_E$ is present; a sensor to detect whether the relatively movable additional mass unit $Z_E$ or additional mass body $Z_M$ is in the starting position; and a sensor to detect, when the locking unit 11 is present, whether the relatively movable additional mass unit $Z_E$ or the relatively movable additional mass body $Z_M$ is in the locked state.

Figure 8:
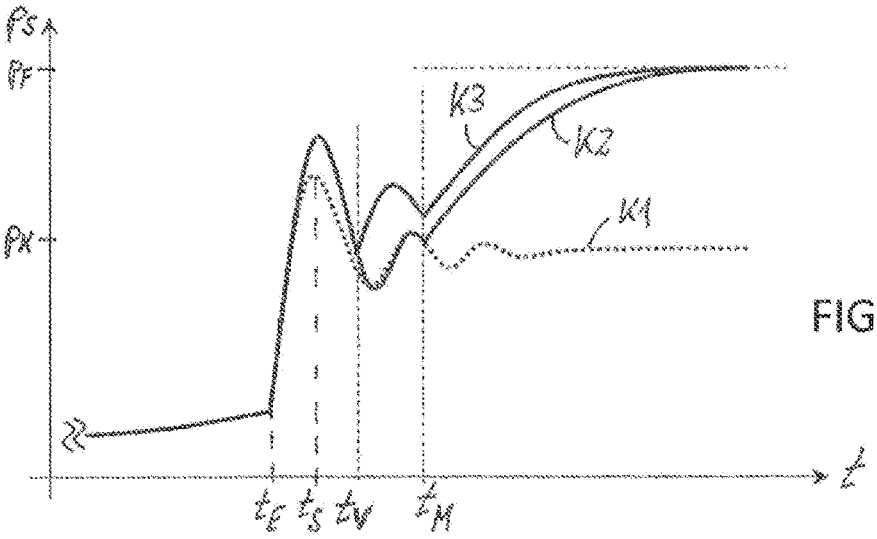
FIG. 8 shows a characteristic curve diagram to illustrate the temporal melt pressure development in a casting mould during a casting process for different performance variants of a casting process according to the invention and not according to the invention.

In a characteristic curve diagram for exemplary embodiments, FIG. 8 illustrates the typical development of the internal mould pressure, i.e. the pressure $p_S$ of the melt material in the mould, as a function of the time t for the last part of the mould filling phase and the subsequent pressure-holding phase. Here, a first curve K1 (shown in dotted lines) illustrates a typical time development of the internal mould pressure $p_S$ for a conventional plunger system without pressure multiplier device. The plunger initially moves e.g. with largely constant advance speed, i.e. filling speed, and as soon as the end of the mould filling phase is reached at a time $t_E$, pressure builds up in the mould which in turn leads to a pressure rise in the casting chamber, whereby the plunger is braked to a standstill, i.e. the momentum of the plunger or the moved system part of the plunger system is dissipated to zero with a corresponding increase of the internal mould pressure. The liquid melt material in the mould to a certain degree acts as compressible, i.e. as a hydraulic spring. At a time $t_S$, the moved system part of the plunger system comes to a standstill for the first time and the maximum pressure value prevails in the mould, i.e. the first pressure peak. Then a certain damped after-oscillation of the internal mould pressure $p_S$ occurs because of a corresponding damped oscillation movement of the moved system part of the plunger system, between the compressible melt material on one side and the compressible hydraulic fluid in the driving casting apparatus on the other, as evident from the course of curve K1.

A second curve K2 illustrates a typical casting process when a plunger system is used with additional mass immovably coupled to the moved system part 2, e.g. the additional mass body ZK according to FIGS. 1 to 3 or the additional mass bodies $ZK_1$, $ZK_2$, . . . according to FIG. 4, and with a pressure multiplier device. Until time $t_E$ at the end of the mould filling phase with the incipient strong pressure rise, the course of the casting process corresponds to that of the conventional case according to curve K1, and here too, said damped after-oscillation occurs on transition to the pressure-holding phase. However, here the internal mould pressure $p_S$ is higher in comparison with the conventional case at the time $t_S$ of the first pressure peak, i.e. curve K2 here lies above curve K1. Also at time $t_M$, the effect of the pressure multiplier device begins, which then brings the internal mould pressure $p_S$ to a desired higher end value $p_F$ that lies significantly above the end value $p_K$ in the conventional case of the first curve K1 without pressure multiplier device. The rise in internal mould pressure $p_S$ at the time of the first pressure peak $t_S$ is attributable to the additional momentum transmission to the melt material in the mould from the additional mass which is immovably coupled to the moved system part 2 of the plunger system and provided by one or more of said additional mass bodies ZK, $ZK_1$, $ZK_2$, . . . and/or by the exchange of corresponding components of the moved system part 2, as explained in FIG. 6, by functionally equivalent components with different mass.

A third curve K3 illustrates an exemplary casting process with use of the plunger system, in an embodiment corresponding to that explained above with respect to the second curve K2, but with additionally present, relatively movably arranged additional mass unit $Z_E$. Since this additional mass unit $Z_E$ deploys its momentum-transmissive effect to the melt material only later by the predefinable delay time than the moved main system part 2*a*, the temporal development of the internal mould pressure $p_S$ in this exemplary embodiment, according to curve K3, corresponds to that of curve K2 up to a time $t_V$ at which this delay time has expired and the additional mass unit $Z_E$ decelerates and transmits its momentum additionally to the melt material. This results in a rise in the internal mould pressure $p_S$ at this time $t_V$, and in the further course of the casting process until the end pressure $p_F$ is reached in the pressure-holding phase, the associated curve K3 lies above the second curve K2 by a corresponding additional pressure. As evident from a comparison of curves K2 and K3, because of the relatively movable arrangement of the additional mass unit $Z_E$, it is possible to provide a desirable amount of pressure increase for the internal mould pressure $p_S$ in the period between the time is of the first pressure peak and the time $t_M$ of the start of the pressure multiplier effect.

As the exemplary embodiments shown and explained above make clear, the invention provides an advantageous plunger system for use in die casting machines, with which the die casting processes can be significantly optimised or improved relative to conventional casting processes, in particular in the period of time at the end of the mould filling phase and on transition to the pressure-holding phase, which in turn allows an increase in the quality of the produced castings. In particular, the compression, strength, porosity and/or structure formation of the casting may be favourably influenced in that the momentum transmission to the melt material can be varied by the mass change of the moved system part without necessarily having to change the advance speed of the moved system part.

The invention allows, independently of each other, a targeted influencing of the mould filling time imposed by the advance speed of the moved system part 2, i.e. the duration of the mould filling phase, and of the pressure value for the internal mould pressure at the time of the first pressure peak since, according to the invention, this pressure value may be changed by the mass change of the moved system part without changing the advance speed. The invention thus allows for example a plunger system to be used with minimal mass of the moved system part—which in principle is favourable for achieving short mould filling times because of higher predefinable advance speed—and the mass of the moved system part to be increased by said measures as required, in order to achieve a desired pressure level for the first pressure peak and/or a pressure rise in a period after the first pressure peak from the delayed action of the relatively movable additional mass unit, in particular as a bridging measure until a pressure multiplier effect begins.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A casting plunger system for a die casting machine, comprising:

a stationary system part; and a system part which moves relative to the stationary system part in a respective casting cycle for introduction of melt material into a casting mould, the system part comprising a casting plunger, a casting plunger rod and a rod drive unit, and being configured to decelerate at an end of a mould filling phase of the casting cycle under the effect of pressure on the melt material, wherein the system part which moves comprises a moved main system part and an additional solid mass unit which is arranged so as to be movable relative to the moved main system part and is configured to decelerate, at an end of the mould filling phase of the casting cycle, later by a predefinable delay time than the main system part.

2. The casting plunger system according to claim 1, further comprising:

one or more additional solid mass bodies which are each configured for releasable attachment to the moved main system part and in the attached state form a component of the moved main system part.

3. The casting plunger system according to claim 2, wherein a plurality of additional solid mass bodies is provided, of which at least two additional solid mass bodies have a different mass.

4. The casting plunger system according to claim 2, wherein the stationary system part comprises an additional solid mass storage unit for stored provision of the additional solid mass body or bodies.

5. The casting plunger system according to claim 2, further comprising:

an additional solid mass handling unit which is configured for automatic attachment and removal of the one or more additional solid mass bodies to and from the moved main system part.

6. The casting plunger system according to claim 1, wherein the relatively movable arranged additional solid mass unit comprises an additional solid mass body which is arranged on the moved main system part to be slidingly movable between a starting position and an end position, where at least one of an initial end stop and an impact end stop is provided on the moved main system part, the initial end stop defining the starting position and the impact end stop defining the end position.

7. The casting plunger system according to claim 6, wherein at least one of:

the initial end stop, or the impact end stop, is adjustable on the moved main system part.

8. The casting plunger system according to claim 6, further comprising:

a locking unit for releasable locking of the additional solid mass body in the starting position or in the end position or in a predefinable locking position between the starting position and the end position.

9. A casting method for a die casting machine with a casting plunger system, said casting plunger system comprising:

a stationary system part; and a system part which moves relative to the stationary system part in a respective casting cycle for introduction of melt material into a casting mould, the system part comprising a casting plunger, a casting plunger rod and a rod drive unit, and being configured to decelerate at an end of a mould filling phase of the casting cycle under the effect of pressure on the melt material, wherein the system part which moves includes a moved main system part and an additional solid mass unit which is arranged so as to be movable relative to the moved main system part and is configured to decelerate, at an end of the mould fill phase of the casting cycle, later by a predefinable delay time than the moved main system part, wherein the casting method comprises:

detecting at least one casting parameter of a respective casting cycle; and variably adjusting a delay time for the relatively movably arranged additional mass unit for one or more future casting cycles depending on the at least one detected casting parameter.

* * * * *